United States Patent [19]

Dunning, III

[11] 4,118,088

[45] Oct. 3, 1978

[54] KNOCK-DOWN FURNITURE SYSTEM

[75] Inventor: John M. Dunning, III, Greensboro, N.C.

[73] Assignee: Dunning, Ltd., Greensboro, N.C.

[21] Appl. No.: 803,988

[22] Filed: Jun. 6, 1977

[51] Int. Cl.[2] ..... A47B 88/04

[52] U.S. Cl. ..... 312/350; 308/3.6; 312/347; 248/239

[58] Field of Search ..... 312/347, 263, 341 R, 312/342, 345, 350; 308/3.6, 3.8; 248/239

[56] References Cited

U.S. PATENT DOCUMENTS

| | | | |
|---|---|---|---|
| 2,686,704 | 8/1954 | Wolters | 312/350 |
| 3,572,874 | 3/1971 | Hassel | 312/341 R |
| 3,580,535 | 5/1971 | Naske | 248/225.1 |
| 3,771,849 | 11/1973 | Barber | 308/3.8 |

*Primary Examiner*—Mervin Stein
*Assistant Examiner*—Alex Grosz

[57] ABSTRACT

Known furniture systems of the knock-down type are provided with improved connecting elements; i.e., hinge fixing plates, drawer slides, shelf supports and facing strips, which facilitate assembly and fabrication increase stability and durability, and refine the appearance of the cabinet. The improved hinge fixing plate includes bearing bosses so arranged and structured as to accept conventionally available hinges in such manner as to permit adjusting of the cabinet door overhang. The improved drawer slide includes a longitudinal open-end rear slot and a transverse or vertical open-bottom forward slot spaced therefrom; the two slots cooperating to form an improved installation means. The shelf support bracket attaches to the side edge of a partial shelf having the ear section cut off to provide clearance for a lighting fixture. The shelf bracket uses countersunk holes to provide clearance between the heads of the attaching screws and the adjusting side walls. A front and rear recess which secures the bracket to the system hardware allow the brackets to be used interchangably on the left or right side. Facing strips releasably attach to and conceal exterior locking pin heads to improve the overall appearance of the cabinet.

3 Claims, 10 Drawing Figures

KNOCK-DOWN FURNITURE SYSTEM

BACKGROUND OF THE INVENTION

Furniture known as "knock-down", or "K-D" furniture in the industry, has developed rapidly during the last few years in response to public demand for a less expensive, more easily assembled, disassembled, transported, stored and reassembled mode of furnishing their homes and/or offices. Many variations of K-D furniture have resulted and most of these variations remain in a state of continual improvement.

Much of such improvement to these furniture units has been in the development of durable and easily operable connecting elements used to support shelves, sliding drawers, doors etc. within the cabinets or enclosures. One significant development in K-D furniture is disclosed in U.S. Pat. No. 3,580,535 to Naske for a connecting fixture used to support shelves within a bookcase or other enclosure.

Naske's device includes a locking pin extending through an opening in a side wall of a cabinet and having a head and shank of the same diameter and a neck of reduced diameter. The head and neck protrude at a right angle from the inner surface of the side wall and receive a cup-shaped element which is mounted in the end or under surface of the cooperating shelf. In use the cup-shaped element slides onto the neck portion of the locking pin and the shelf is thereby supported (by a plurality of these pins and cup-shaped elements) within the enclosure. The same pins are also used to connect hinge plates, drawer slides, and the like.

The above and other types of locking pin systems have been widely utilized in K-D furniture because of their inherent versatility and ease in the adjusting and positioning of enclosure components. Parallel rows of apertures are drilled into or through side walls of the cabinet, and the locking pins are inserted into and held in the selected apertures. The shelves as described above, and other components with corresponding adapting elements are then connected to the locking pins.

However, many disadvantages still exist in the use of the above described pin system and these include: adaptability of existing conventional door hinges, drawer slides, and other hardware for use with such a K-D pin system; ease with which the enclosure may be erected; close tolerances required for fabricated end wall blanks; stability/durability; capacity for adjusting or aligning hinges to correct sagging doors; and aesthetic appearance.

As far as previous drawer slides are concerned considerable difficulty has been encountered in mounting the slides on the locking pins through the elongated holes provided at spaced points in the slide. The connecting pins on the inner side wall are not readily visible and it is difficult to properly position previously known slide for mounting. Also if the holes are not drilled to close tolerances, it has been found that the pins may not line up with the cooperating openings in the slide.

There has developed a lighted shelf with a cabinet lamp attached to the rear edge that is cut away several inches. Bracket extensions extend the side of the shelf edge rearwardly to make connection with the rearmost locking pin. Such extensions now require left and right members fabricated and kept separately, which is expensive.

Existing hinge plates for such a pin system are not compatible with conventionally available hinges, and therefore require special hinges which do not work well and hinder adjustment. Also the pins and apertures extend through the outer side walls and present a rather unsightly appearance on the exterior visible surfaces.

SUMMARY OF THE PRESENT INVENTION

The present invention is therefore directed to a knock-down cabinet enclosure having significant improvements made to the connecting elements presently being used in conjunction with the aforementioned locking pin system. Modifications to the hinge fixing plates, drawer slides, and shelf supports and the inclusion of a cover strip to conceal the apertures and locking pins, constitute a novel approach to the solution of the aforementioned disadvantages of conventional locking pin systems.

In general, the cabinet enclosure with which the improved connecting elements are to be used includes adjoining side, bottom, top and rear walls, an open front, and associated components including shelves, doors, and sliding drawers. The enclosure is purchased in its disassembled form for economy in shipping or storage and may be erected substantially without use of tools or other equipment. As a result of the improved connecting elements, the cabinet according to the present invention is more easily erected, aligned and adjusted, and may be repeatedly disassembled and assembled without undue stress or damage to the structure.

Improvements to the connecting elements according to the present invention are primarily directed to the fixing plate for the door hinges, to the drawer slides, to the lighted shelf support brackets, and a novel improvement to overall appearance by the addition of a facing strip which conceals the locking pin heads and apertures on the exterior (and interior if desired) surfaces of the cabinet.

In the aforementioned fixing plate, modifications include the provision of an extension on either side of the body portion and an elongated raised boss thereon underneath the adjusting screw. When the adjusting screw is rotated inwardly or outwardly the corresponding increasing/decreasing pressure against the boss will adjust the door laterally to correct door alignment. A further modification to the fixing plate is in adapting the new design to conform to a conventional 37 mm setback of the pin apertures from the wall edge which conforms to standard hardware, thereby increasing the fixing plate's versatility for use with many types of existing hinges. Existing hinges for the pin system described utilize a 30 millimeter set back, which is not compatible with existing hardware design.

The drawer slide according to the present invention includes significant improvement in the structure thereof to facilitate installation, as well as increasing the strength and durability thereof. Prior art slides have been constructed from wood or a durable plastic with a rather long flat span between the support points. These slides were not particularly strong and, additionally, were difficult to install because of the necessity to have them in exact alignment before slipping them over the locking pins. Alignment was often difficult to achieve when manipulating the drawer slides within the confines of a cabinet. According to the present invention, the drawer slide is designed such that the rear portion includes an open ended elongated slot by means of which the slide is slipped by an initial lateral movement to engagement with the rear locking pin. The front portion is then pivoted downwardly over the forward locking pin. There is therefore no necessity to align the drawer slide simultaneously over the two corresponding locking pins during installation.

Regarding the adjustable shelves within the cabinet, a shelf support means has been perfected which enables the installation of a narrow shelf in the front area of the cabinet with the rear area behind removed to provide space at the rear of the shelf for an interior lighting component. Such shelves require an extension bracket to secure the shelf to the rear pins. These brackets are secured to the side edges of the partial shelf, extended rearwardly therefrom, and include a notch or slot at the rear end thereof. Formerly a left and right extension bracket was required; but as a result of the present invention, a single bracket may be utilized on either the left or right side.

To further improve the appearance of the cabinet, the present invention includes a facing strip which is so constructed as to enable it to be snapped over the exposed locking pins on the exterior walls of the cabinet to conceal the pins, cover the remaining apertures, and provide a finished appearance to the cabinet.

It is therefore an object of the present invention to provide an improved knock-down furniture system.

It is a further object of the invention to provide improvements to knock-down furniture systems including connecting elements which are compatible and interchangeable with existing furniture hardware.

Another object of the present invention is to provide improved connecting elements for knock-down furniture systems which facilitate assembly and alignment, while allowing looser tolerances.

Still another object of the present invention is to provide a knock-down furniture system of the type described, in which the doors may be easily and satisfactorily adjusted for overhang, etc.

It is also an object of the present invention to provide a knock-down furniture system which includes improved shelf brackets for indirect interior lighting.

Still other and further objects of the present invention will be obvious to those skilled in the art as the following detailed description is studied in conjunction with the attached drawings in which.

DETAILED DESCRIPTION OF PREFERRED EMBODIMENT

General Structure

Figure 1:
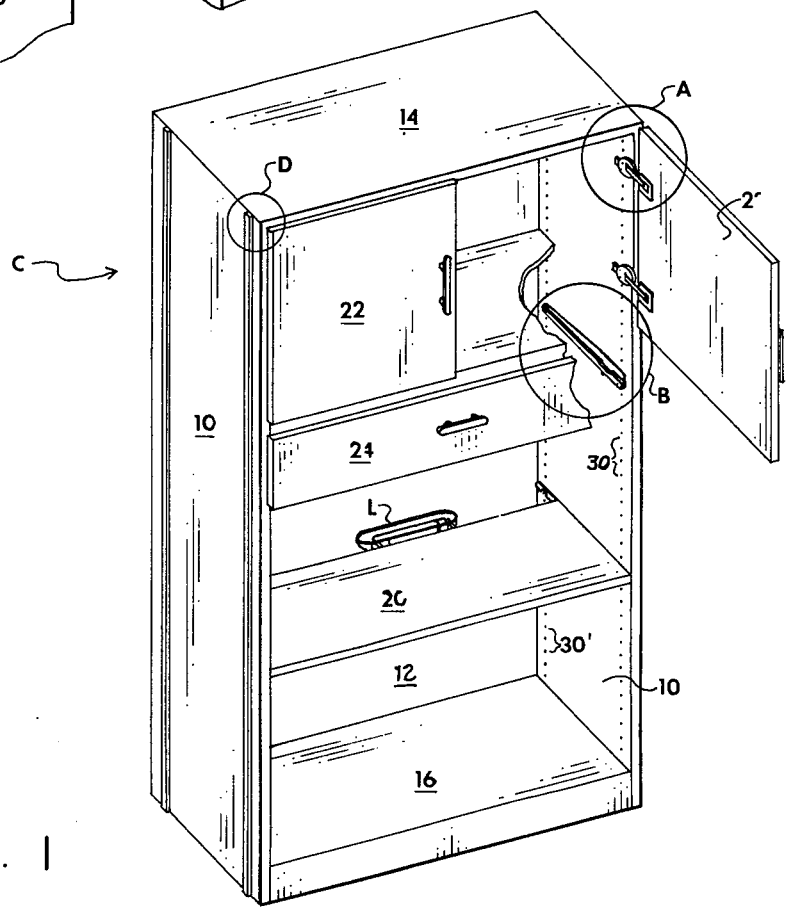
FIG. 1 is a perspective view, with parts broken away, of a knock-down cabinet with each of the improvements according to the present invention incorporated therein.
Figure 3:
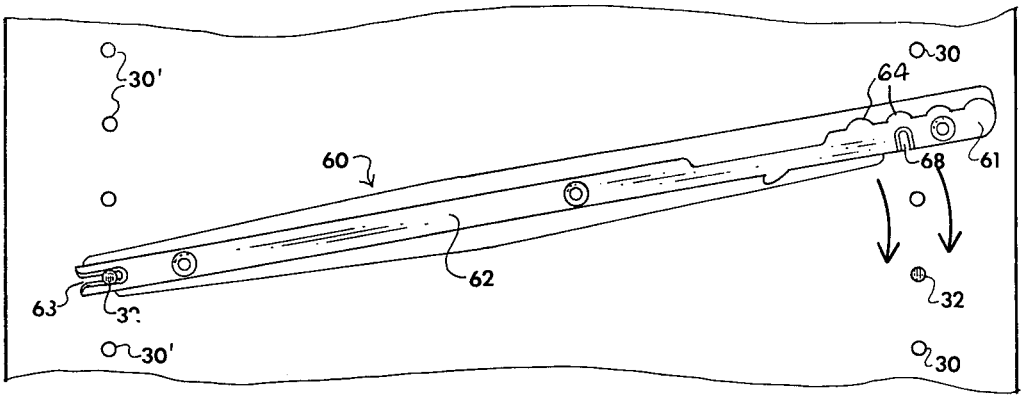
FIG. 3 is a partial perspective view illustrative of Area B of the side wall of the cabinet from FIG. 1.
Figure 5:
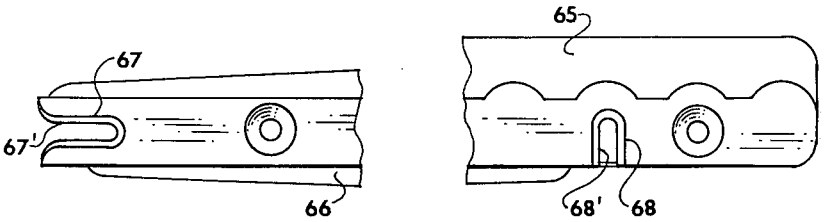
FIGS. 4–6 are perspective, side, and plan views, respectively, with parts broken away of the improved drawer slide.
Figure 6:
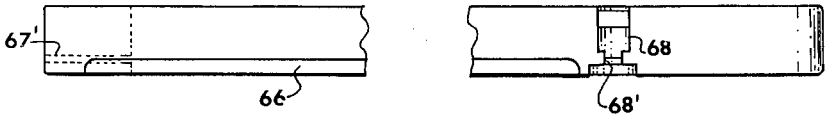

Turning now to a discussion of the drawings, FIG. 1 illustrates an exemplary knock-down cabinet construction C of the type with which the components of the present invention are adapted for use. Cabinet C includes side walls 10, rear wall 12, top 14, bottom 16, and an open front. Cabinet C further includes structural components in the form of shelves 20, doors 22, and a sliding drawer 24, and is of the type generally known to the furniture industry as knock-down furniture because the structural components may be easily disengaged from the primary cabinet structure and the remaining walls folded or disassembled for storage or moving.

Figure 8:
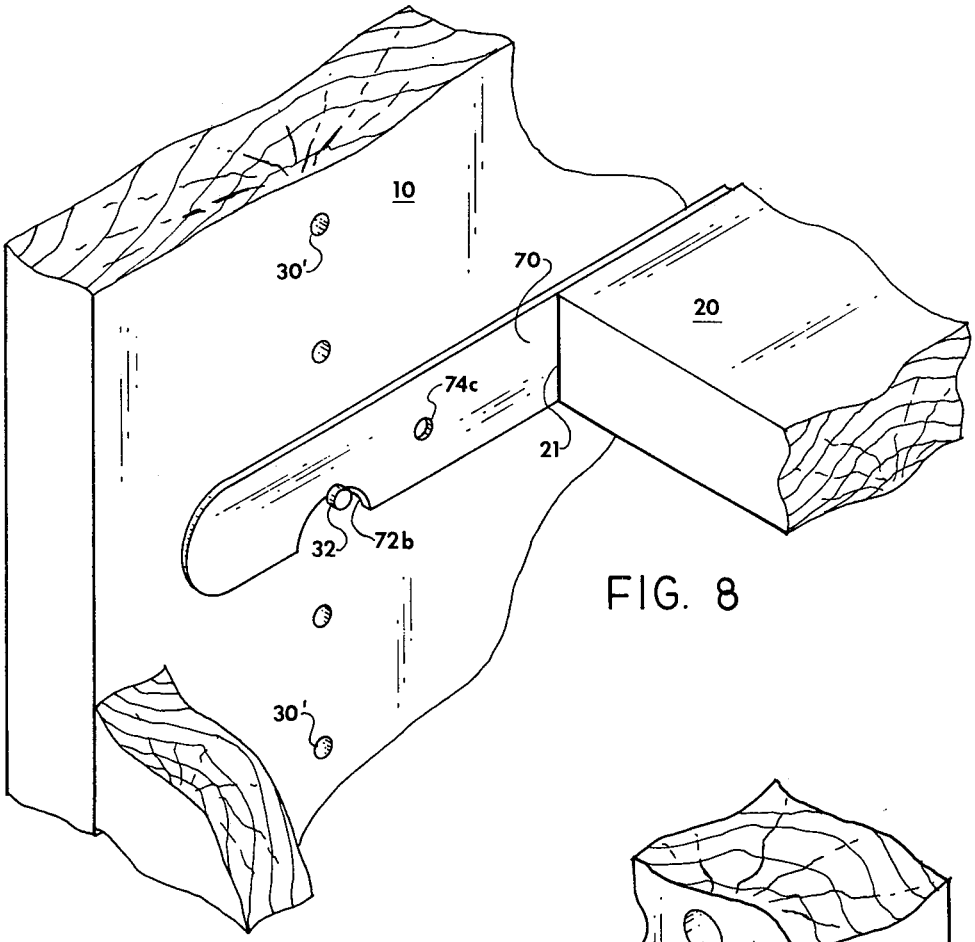

The locking pin system used to erect the cabinet is best shown in FIG. 8, and includes parallel vertical rows of apertures 30 and 30′ which are drilled or otherwise formed through side walls 10 of cabinet C, one row 30 being approximately 37 mm from the front edge and the other row 30′ adjacent the back edge. Locking pins 32 include a shaft portion 34 and a locking head 36 on each end of, and of substantially the same diameter as, the shaft. A reduced neck portion 35 separates the shank or shaft 34 from head 36 and provides the point at which other connecting elements are attached. An enlarged collar or stop 37 surrounds the shank portion 34 at one end thereof. The pins 32 are inserted through the appropriate selected apertures 30,30′ so that a locking head 36 and associated neck 35 is exposed on both the interior and exterior surfaces of the side walls 10. Where only one end of pin 32 is to receive a locking element, the pin is inserted from the opposite side of wall 10 with collar 37 on such opposite side.

Connecting elements within the purview of this invention include hinge fixing plates 50, drawer slides 60, shelf support brackets 70, and facing strips 80. All have slots and/or apertures (which will be described in more detail hereinbelow) which engage over or around the locking heads 36 to eventually mount the doors 22, drawer 24, shelves 20, and other selected components to the primary structure of cabinet C. Each of these connecting elements will be discussed individually below.

Further discussion of the locking pin system used in conjunction with the present invention will not be included herein. The pin system is well known to those skilled in the art and does not in and of itself form any part of applicant's invention.

Fixing Plate for Hinges

Figure 2:
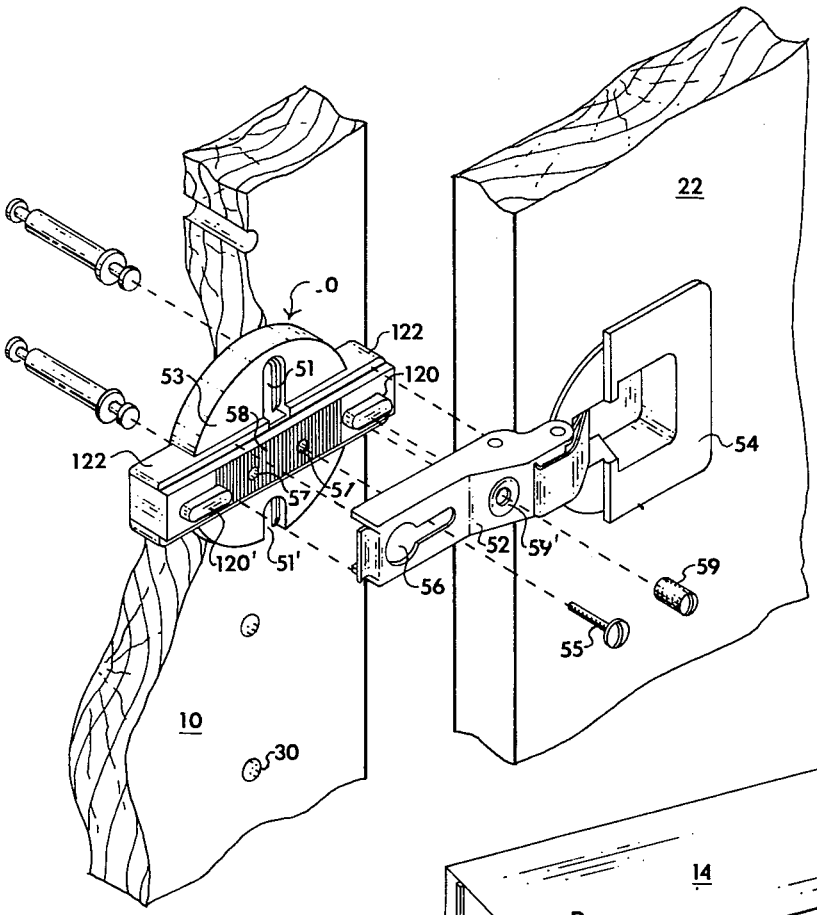
FIG. 2 is an exploded perspective view, illustrative of Area A and the improved fixing plate for hinges as described herein.

Turning now to a discussion of the first of the connecting elements, fixing plate 50 is best illustrated in FIG. 2 and includes a generally circular or disc-shaped body member 53. Fixing plate 50 is removably attached to the inside surface of side wall 10 of the cabinet by means of a pair of elongated slots 51,51′ which fit over a pair of correspondingly spaced, vertically aligned pins 32. A hinge arm 52, pivotally attached to a base plate 54 which, in turn, is fixed by screws to cabinet door 22, is connected to fixing plate 50 by means of a flat-head screw 55 which extends through a slot 56 in hinge 52 and into one of two holes 57 in body member 53. U.S. Pat. No. 3,731,343 to Naske discloses a furniture hinge with the aforedescribed features for use with a K-D furniture pin system. A disadvantage to Naske's hinge is the fact that a hinge adjusting screw, which is shown in the Naske patent, does not have a surface or boss on the fixing plate against which the adjusting screw can strike when rotated inwardly to adjust for door overhang. Rather, Naske provides a threaded hole into which a flat head screw is placed. As the screw is backed out it engages the undersurface of hinge 52 to make adjustments thereto. This has proved to be most difficult in operation, with the result that hinge adjustment is seriously hampered. The fixing plate illustrated in the Naske patent is not compatible with other types of hinges, so that the above problem cannot be overcome by using other available hinge systems which in themselves are not compatible with the pin system.

The hinge fixing plate 50 according to the present invention, however, makes it compatible with other available hinge systems by the addition of a pair of elongated raised bosses 120,120'; one boss affixed to the top surface of an ear or extension 122 on each end of a serrated hinge arm guide bar 58. By being elongated the bosses are much more compatible with diverse hinge systems in which the distance between the attaching screw 56 and adjusting screw 59 may vary. The bosses 120,120' project approximately ¼ inch above the guide 58 to a point substantially adjacent the undersurface of hinge arm 52. When the hinge arm 52 is positioned over and attached to the fixing plate 50, the adjusting (set) screw 59 will be immediately above and almost engaging boss 56. Therefore, the adjusting screw 59 strikes a hard surface when rotated inwardly through a threaded opening 59' and will permit much more accurate alignment of the cabinet door according to the depth and direction of screw rotation.

The extensions 122 increase the length of hinge arm guide 58 to make the guide compatible with hinge arms of varying dimension, such as those used with systems employing the 37 mm setback. Slots 51,51' engage the locking pins 32 as described hereinabove to affix the plate to the cabinet wall.

Drawer Slide

Turning now to FIGS. 3–6, the drawer slide 60 includes a longitudinally extending bearing member 62 which supports the drawer or drawer rollers. On the upper surface of bearing member 62 the drawer moves backward and forward. The upper surface of bearing member 62 preferably, but not necessarily, includes a plurality of ridges 64 at the front end thereof which act as a stop for the drawer to prevent its being pushed too far back into the enclosure.

To strengthen the drawer slide 60 and prevent bowing and possible bending under the weight of the drawer, the slide 60 which is preferably molded from a rigid plastic material, includes an upper flange 65 and a lower flange 66 molded integrally therewith. The flanges 65 and 66 generally serve as stiffeners to decrease the flexibility of the drawer slide when weight is applied and additionally serve as transverse guides or buffers between the drawer and the side wall of the cabinet as the drawer moves back and forth.

The heart of the improvements to the drawer slide 60 resides, however, in the unique slot arrangement which facilitates assembly of the slide onto pins 32. First of all, by way of orientation, the slide 60 includes a front end 61 and a rear end 63. An elongated, longitudinally extending slot 67 at the rear includes an open rear end and a diameter slightly greater than the corresponding diameter of a pin head 36. A retaining means in the form of a ledge 67' extends inwardly from the wall of slot 67 to a point where opposite edges of the ledge are separated by a distance greater than the diameter of the pin neck, but less than the pin head diameter, so that the pin head 36 against ledge 67' retains the drawer slide 60 against the side wall 10 of the cabinet. A second elongated, transversely extending slot 68 near the front end 61 includes an open bottom end and a diameter slightly greater than the diameter of a pin head 36. Again a retaining means (ledge 68') extends inwardly from the walls of slot 68 similarly to ledge 67'.

In use, the drawer slide 60 is removably attached to the cabinet by first engaging the rear slot 67 on the pin 32 which is positioned in the rear row 30' of apertures, followed by a lateral movement toward the rear wall of the cabinet. The front portion of drawer slide 60 is then pivoted downwardly bringing slot 68 into engagement over a second, front locking pin 32 in the forward row of apertures 30. The slide 60 is thus quickly, easily, and firmly secured against side wall 10. In alternate furniture systems, which do not use pins 32, screws may be inserted in selected apertures 69 along the length of slide 62. However, the drawer slide 60 will perform satisfactorily without the use of screws and, if screws are not used, there is no resulting permanent damage to the cabinet walls.

Shelf Support Bracket

Figure 7:
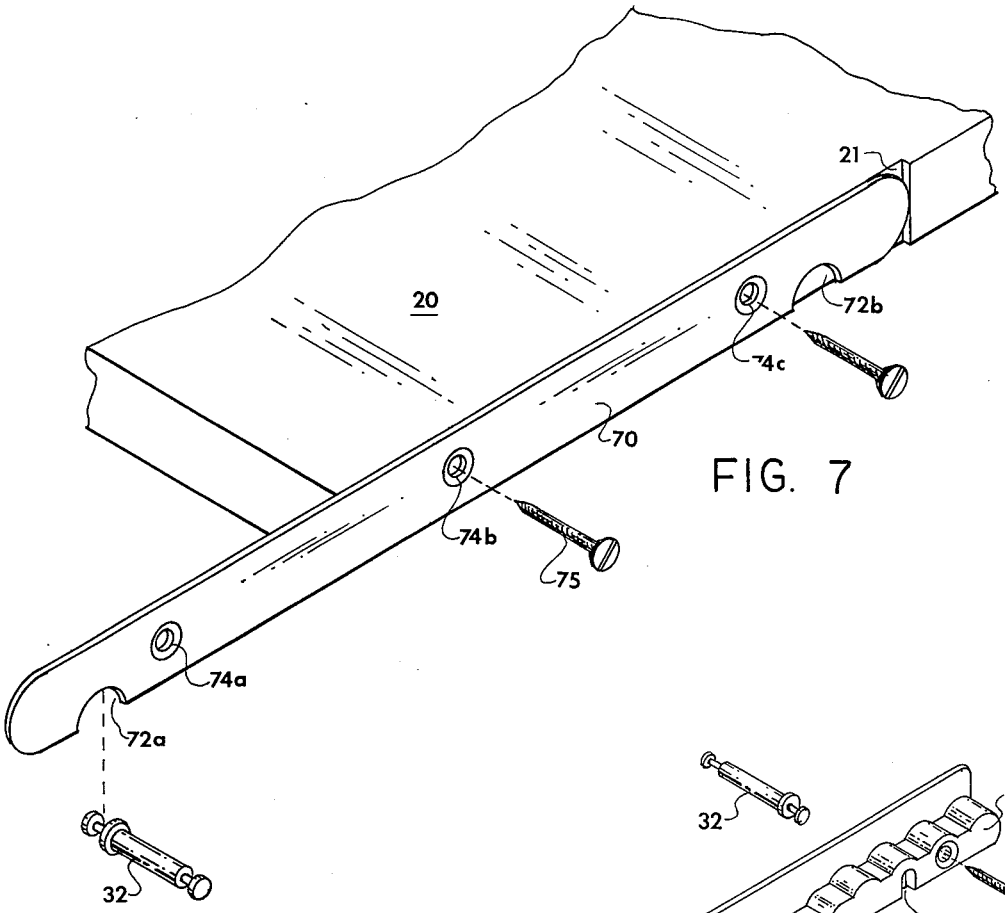
FIGS. 7 and 8 are partial perspective views with parts broken away, illustrative of Area C showing opposite sides of the partial shelf and its improved extension bracket.
Figure 4:
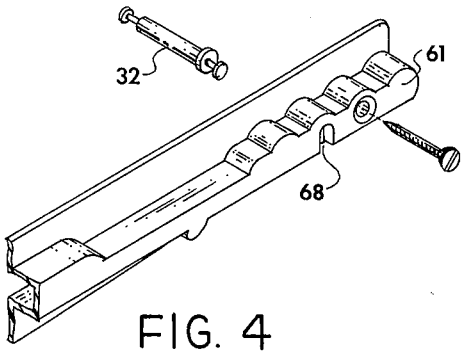

The new lighted shelf 20 is best illustrated in FIGS. 7 and 8, and includes a narrow shelf member which is cut of such a size as to extend from the front of the cabinet to a point spaced from the rear. The side edge of the shelf is secured to the pin 32 in the front row 30 of apertures in the manner described hereinabove. However, a bracket or extension 70 is necessary to mount the shelf to the pins in the rear row 30' of apertures. Bracket 70 is die cut or otherwise formed in the preferred shape as illustrated. The design includes a pair of pin engaging notches *72a, 72b* at either end and a plurality of spaced, counter-sunk apertures *74a–c* along the length thereof for receiving mounting screws 75. The support 70 is reversible for use on either the left or right side edge of the shelf 20. To install on the left hand side as illustrated, the support 70 is attached with screws inserted through the front two apertures *74b,74c* to the rear of shelf edge 21 so that a segment of the support 70 including notch *72a* extends beyond the rear edge of the shelf 20 as shown. The distance between notch *72a* and shelf 20 is such that notch *72a* will seat over a locking pin 32 in the rear row 30' of apertures in the cabinet side wall. A void is thereby created between the rear edge of the shelf and the back wall of the cabinet wherein a lighting fixture L (FIG. 1) may be recessed. To use as a right hand bracket, the bracket is turned around and mounted to the opposite end of a shelf utilizing apertures *74a, 74b* and notch *72b*.

Facing Strip

Figure 10:
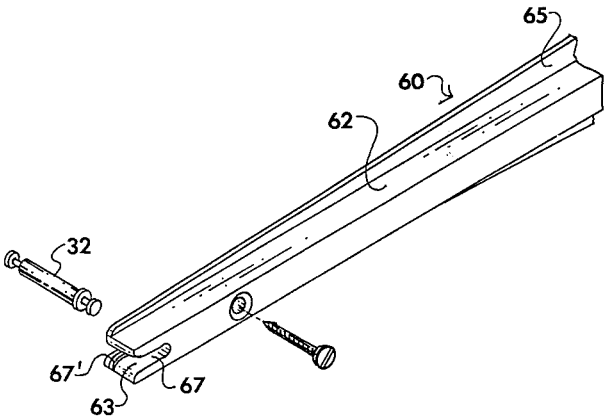
FIG. 10 is a sectional view taken substantially along lines 10—10 in FIG. 9.
Figure 10:
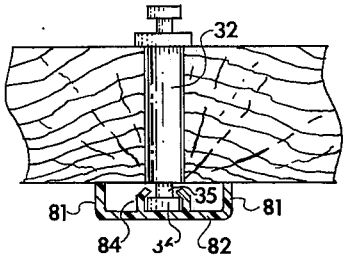
Figure 9:
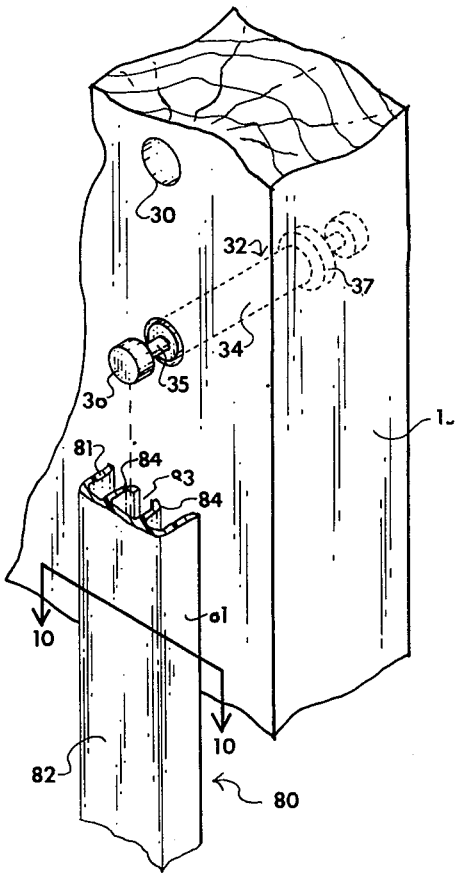
FIG. 9 is an exploded partial perspective view of Area D illustrating the exterior side wall of the cabinet with a portion of a facing strip illustrated thereon.

A facing strip 80, as illustrated in FIGS. 9 and 10, is a decorative extrusion having side walls 81, a top wall 82 and an open channel or track 83 between spaced rails 84 extending substantially the entire length of the extrusion. The rails 84 are flexible to permit the edges thereof to expand and contract so as to be snapped into place around exposed locking pin heads 30 as illustrated in FIG. 10 to conceal the pins and the apertures 30,30', which are otherwise visible along the exterior surface of the cabinet.

The facing strip 80 does not contribute to the stability of the enclosure C but is a novel approach to improving the appearance in that it may be easily removably attached as often as desired without damage to the strip or cabinet surface because there is no adhesive or other agent utilized.

The facing 80, preferably a plastic extrusion, may be finished to blend with any cabinet finish in colors, metallic look, or woodtones, or it may be extruded from metal such as aluminum or brass to impart a decorative trim against the contrasting cabinet wall.

The above improvements to the knock-down furniture system are described according to a preferred embodiment of the present invention and are exemplary only. Various modifications may be made without departing from the scope of the invention as claimed below.

What is claimed is:

1. Improvements in a knock-down furniture system of the type in which a plurality of holes are arranged in a pair of horizontally spaced, vertical rows adjacent the front and rear edge of the side walls thereof and receive connecting pins having a head and reduced neck portion which extend outwardly from at least one surface of the side walls and onto which various hardware and connecting fixtures are attached, said improvements comprising:

(a) at least a pair of drawer slides each having a front and rear end and releasably attached to a laterally spaced pair of said pins;

(b) said drawer slide including an elongated body member having a longitudinally elongated slot opening toward the rear end thereof and a transversely extending elongated slot opening at the bottom of said body member adjacent the front end thereof;

(c) whereby said drawer slide may be releasably secured to said side wall by moving the slide rearwardly while sliding said rear slot onto the pin at said rear, then pivoting said slide downwardly into locking engagement with the corresponding pin at said front side.

2. Improvements in a knock-down furniture system of the type in which a plurality of holes are arranged in a pair of horizontally spaced, vertical rows adjacent the front and rear edge of the side walls thereof and receive connecting pins having a head and reduced neck portion which extend outwardly from at least one surface of the side walls and onto which various hardware and connecting fixtures are attached, said improvements comprising:

(a) at least a pair of drawer slides each having a front and rear end and being releasably attached to a laterally spaced pair of said pins;

(b) said drawer slide including an elongated body member having a longitudinally elongated slot opening toward the rear end thereof and a transversely extending, elongated slot opening at the bottom of said body member adjacent the front end thereof;

(c) said drawer slide including an elongated bearing member extending longitudinally substantially the entire length of said drawer slide, and an upper and lower flange extending upwardly and downwardly respectively from the upper and lower surface of said bearing member, said flanges serving to stiffen and decrease the flexibility of said drawer slide and prevent bowing thereof responsive to the application of weight thereon;

(d) said drawer slides being releasably secured to said side walls by moving the slide rearwardly while sliding said rear slot onto the pin at said rear, then pivoting said slide downwardly into locking engagement with the corresponding pin at said front side.

3. The improvement according to claim 2 wherein said front and rear slots include a retaining means of a reduced diameter extending inwardly from the walls thereof for sliding under said head and around said reduced neck portion to maintain said drawer slide in assembled relationship against said side wall.

* * * * *